US008122745B2

(12) United States Patent
Ramsauer et al.

(10) Patent No.: US 8,122,745 B2
(45) Date of Patent: Feb. 28, 2012

(54) HANDLE WITH A CLOSURE INSERT

(75) Inventors: Dieter Ramsauer, Schwelm (DE); Klaus Bergmann, Essen (DE); Frank Noethe, Witten (DE); Thorsten Kuester, Ennepetal (DE)

(73) Assignee: Dirak Dieter Ramsauer Konstruktionselemente GmbH, Ennepetal (DE)

( * ) Notice: Subject to any disclaimer, the term of this patent is extended or adjusted under 35 U.S.C. 154(b) by 318 days.

(21) Appl. No.: 12/412,088

(22) Filed: Mar. 26, 2009

(65) Prior Publication Data

US 2009/0179439 A1 Jul. 16, 2009

Related U.S. Application Data

(63) Continuation of application No. 12/224,471, filed as application No. PCT/EP2007/001065 on Feb. 8, 2007.

(30) Foreign Application Priority Data

Mar. 2, 2006 (DE) ..... 20 2006 003 304 U

(51) Int. Cl.
*E05B 13/10* (2006.01)

(52) U.S. Cl. ..... 70/224; 70/139; 70/207; 70/221; 70/448; 292/336.3

(58) Field of Classification Search ..... 70/135, 70/139, 207, 215, 224, 448, 450, 452, 208–210, 70/216, 217, 221–223; 292/336.3
See application file for complete search history.

(56) References Cited

U.S. PATENT DOCUMENTS

| | | | | |
|---|---|---|---|---|
| 2,605,630 | A * | 8/1952 | Keeler | 70/181 |
| 3,507,132 | A * | 4/1970 | Schwenk | 70/224 |
| 3,593,550 | A * | 7/1971 | Berkowitz | 70/207 |
| 4,883,296 | A * | 11/1989 | Laurie | 292/336.3 |
| 5,450,737 | A * | 9/1995 | Sasaki | 70/346 |
| 5,490,404 | A * | 2/1996 | Yamada | 70/210 |
| 6,240,751 | B1 * | 6/2001 | Marzolf et al. | 70/207 |
| 6,361,088 | B1 | 3/2002 | Ramsauer | |
| 6,490,896 | B2 * | 12/2002 | Segawa | 70/208 |
| 6,543,090 | B2 * | 4/2003 | Muneta | 16/412 |
| 6,668,602 | B2 * | 12/2003 | Graham et al. | 70/208 |
| 6,851,289 | B2 * | 2/2005 | Ramsauer | 70/208 |

(Continued)

FOREIGN PATENT DOCUMENTS

DE 9406584 7/1994

(Continued)

*Primary Examiner* — Suzanne Barrett
*Assistant Examiner* — Christopher Boswell
(74) *Attorney, Agent, or Firm* — Frommer Lawrence & Haug LLP

(57) ABSTRACT

The invention relates to a handle (e.g., a fixed handle, rotary handle, or swivel lever handle) particularly with a lock insert or the like or escutcheon for mounting in a preferably thin wall (e.g., a sheet metal cabinet door leaf, sheet metal drawer front, or sheet metal box lid). Wherein the handle has a longitudinal extension at whose ends is arranged at least one fastening means (e.g., a screw, nut, hook fastening or clip-in fastening). The lock insert includes a housing with a collar in the vicinity of its front end, and a receiving space for the front end of the housing with the collar is provided at this end of the handle in the vicinity of the fastening means proceeding from the contact surface contacting the thin wall, this receiving space passing through the handle to the front side of the handle while changing in cross section.

13 Claims, 12 Drawing Sheets

U.S. PATENT DOCUMENTS

| | | | | |
|---|---|---|---|---|
| 7,194,881 | B2 * | 3/2007 | Kutschat | 70/224 |
| 7,665,335 | B2 * | 2/2010 | Stuckey | 70/208 |
| 2007/0062004 | A1 | 3/2007 | Ramsauer | |

FOREIGN PATENT DOCUMENTS

| | | |
|---|---|---|
| DE | 202004004066 | 7/2005 |
| EP | 0649955 | 4/1995 |
| EP | 1158123 | 11/2001 |
| EP | 1455037 | 9/2004 |
| GB | 1225548 | 3/1971 |
| GB | 1504779 | 3/1978 |
| GB | 2129480 | 5/1984 |
| WO | 99/32746 | 7/1999 |
| WO | 2005/083207 | 9/2005 |

* cited by examiner

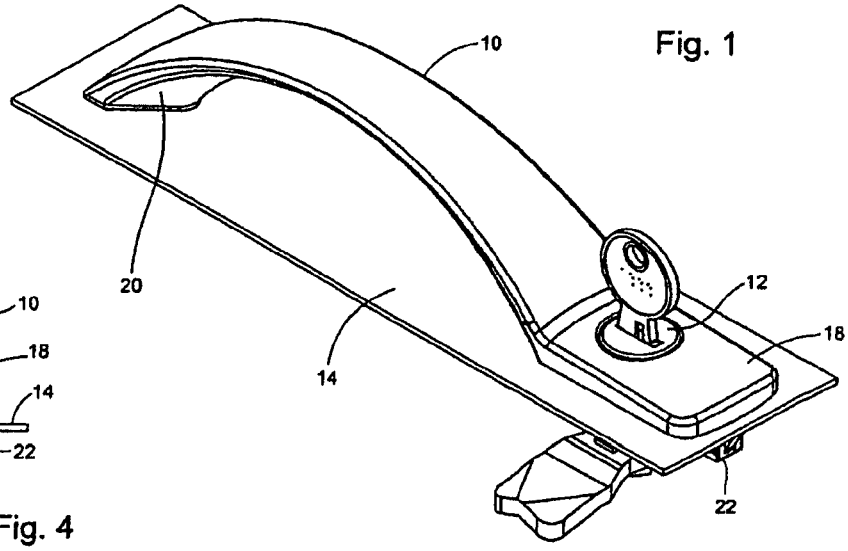
Fig. 1
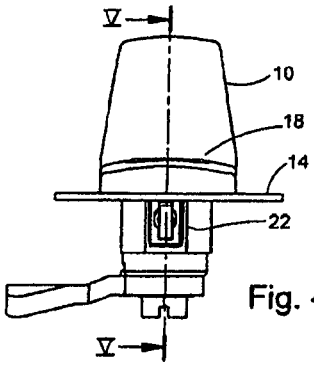
Fig. 4
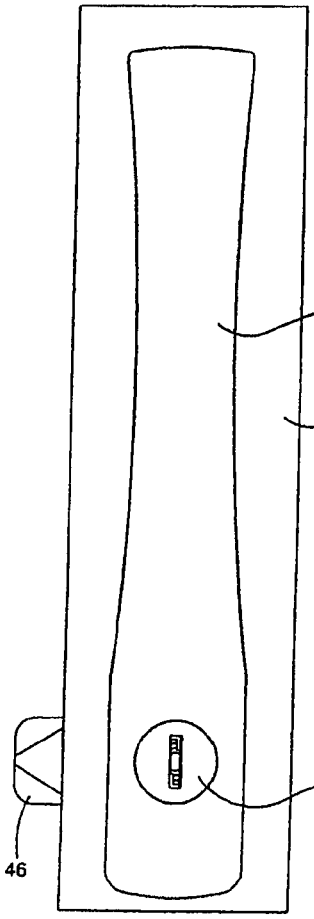
Fig. 3
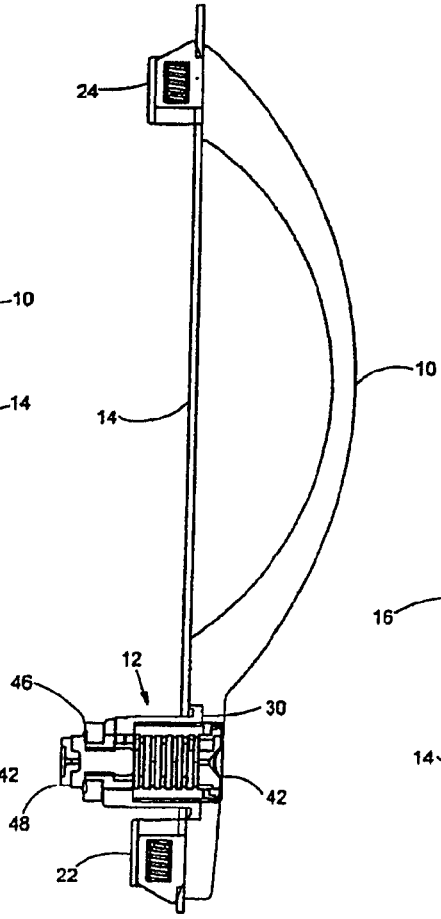
Fig. 5
Fig. 2
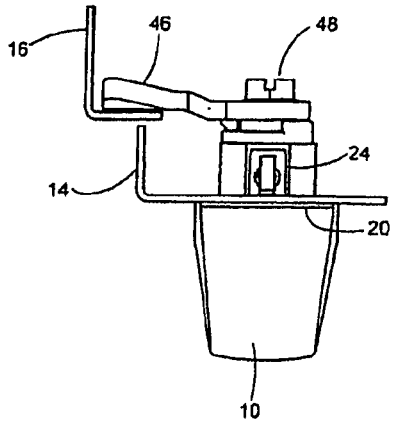

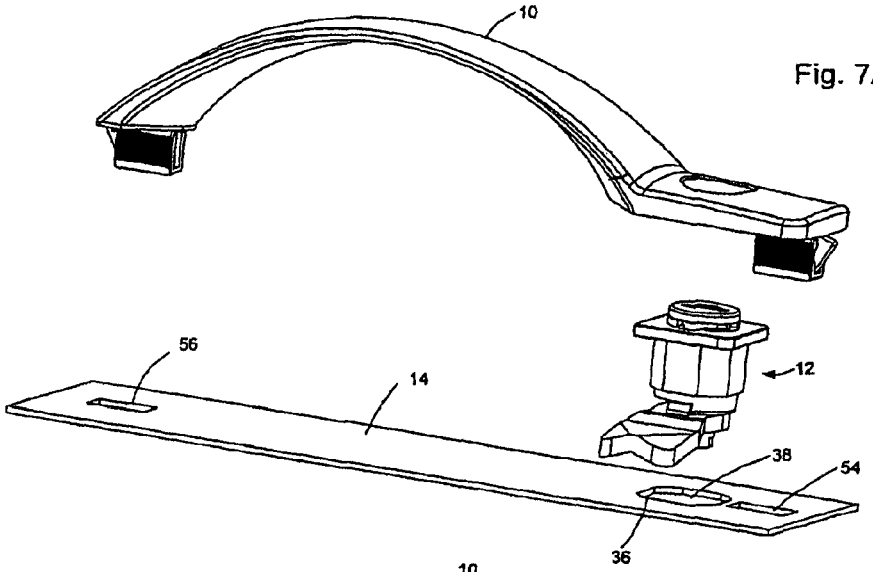
Fig. 7A
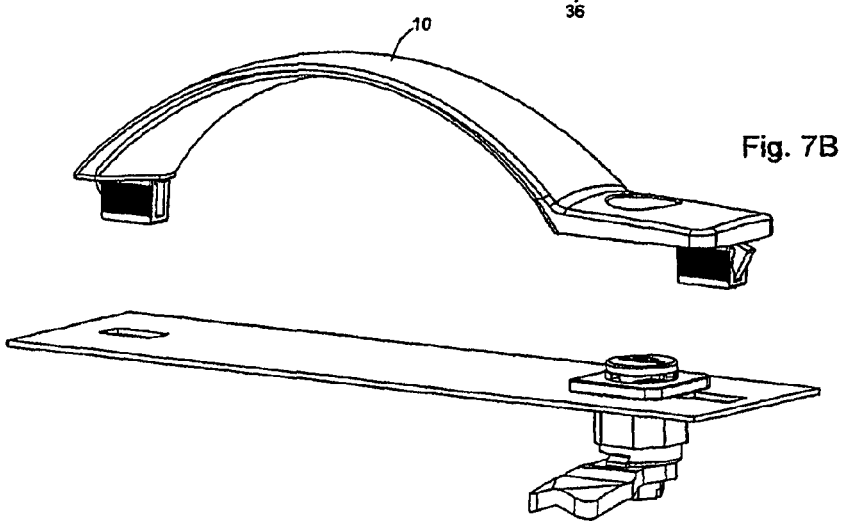
Fig. 7B
Fig. 8
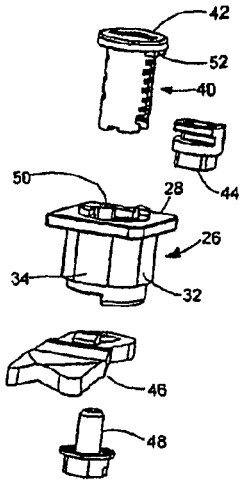
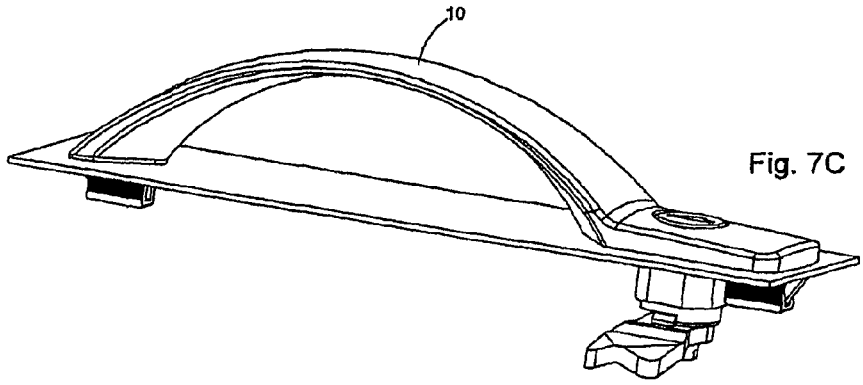
Fig. 7C

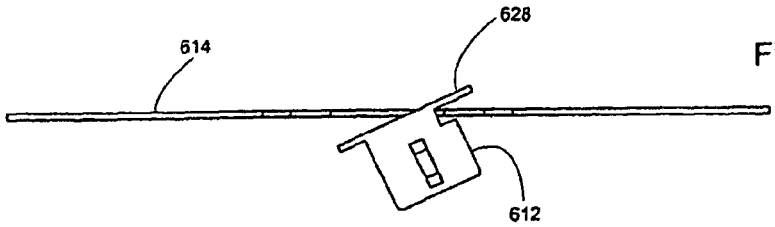
Fig. 13 A
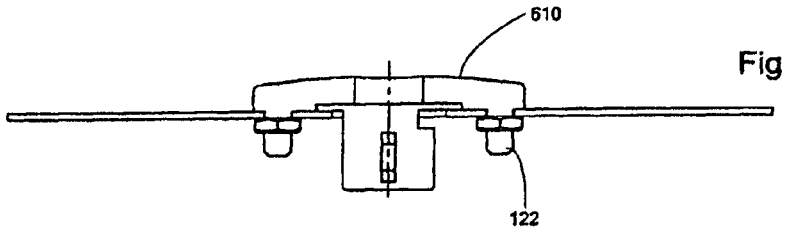
Fig. 13 B
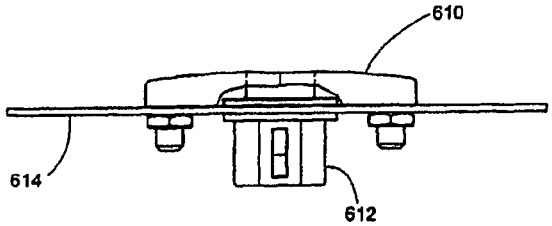
Fig. 13 C
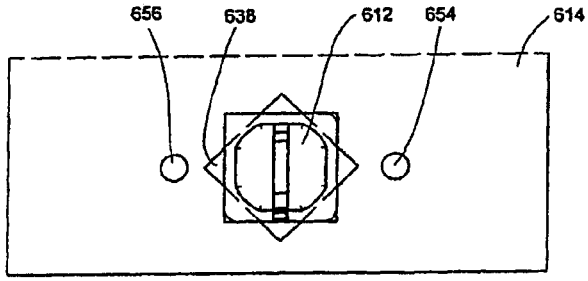
Fig. 13 D
Fig. 14
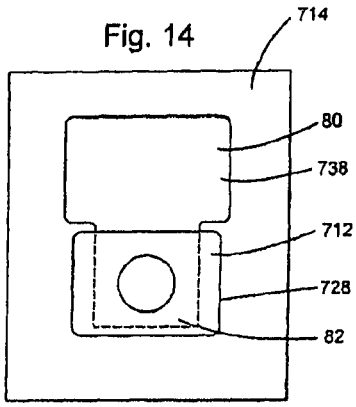
Fig. 15
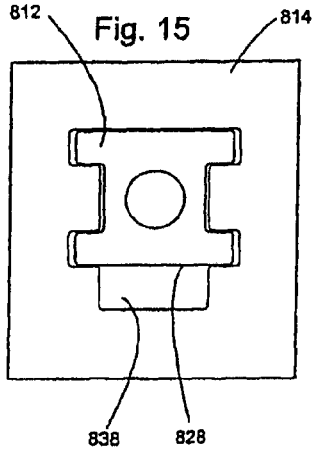
Fig. 16
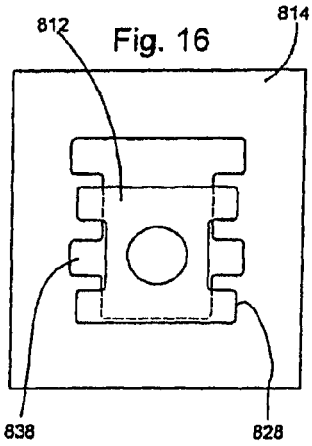

Fig. 17 B
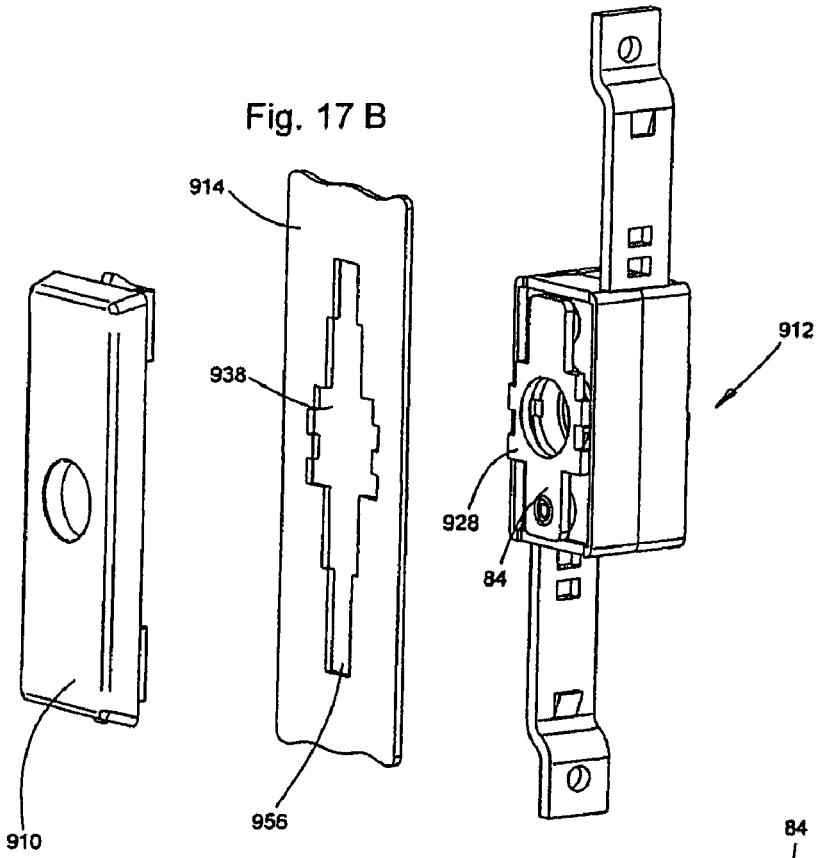
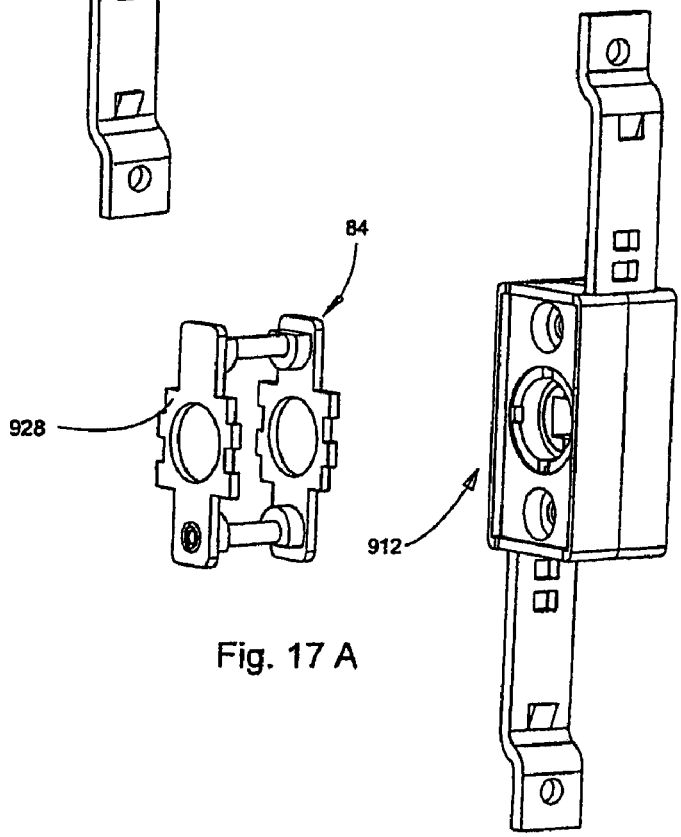
Fig. 17 A
Fig. 17 C
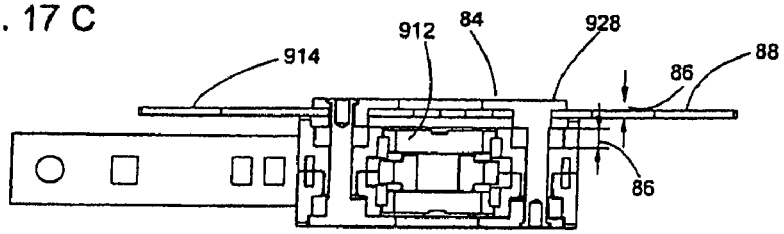

Fig 18A
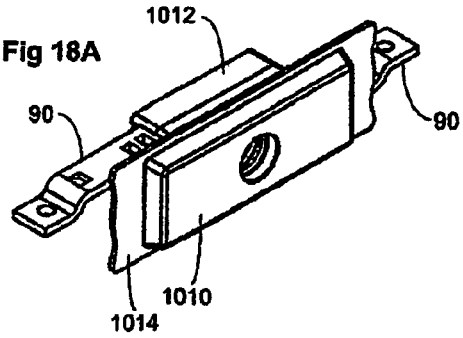
Fig 18B
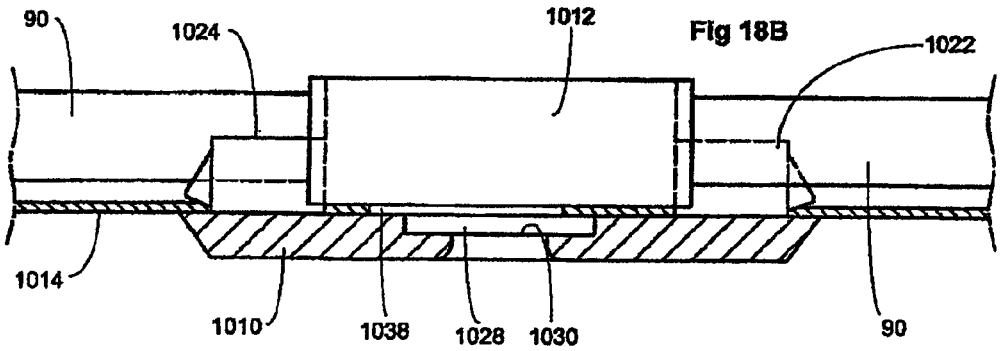
Fig 18C
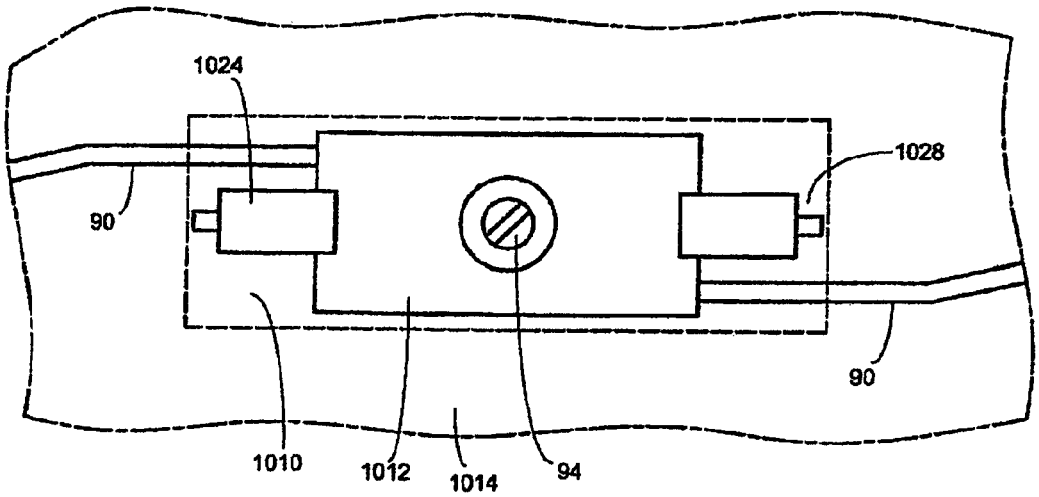
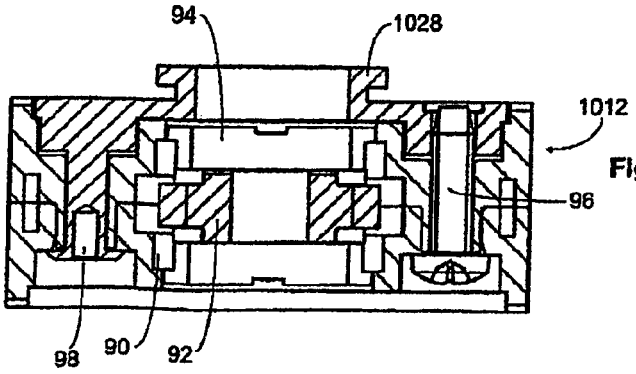
Fig 18D

HANDLE WITH A CLOSURE INSERT

This a continuation application of application Ser. No. 12/224,471, filed Feb. 25, 2009, which is a National Phase application of International Application No. PCT/EP2007/001065 filed on Feb. 8, 2007, which claims priority from German Patent Application No. 20 2006 003 304.1 filed on Mar. 2, 2006, the disclosure of which is incorporated herein by reference in its entirety.

BACKGROUND OF THE INVENTION

1. Field of the Invention

The invention is directed to a handle or the like with a lock insert or the like for mounting in a preferably thin wall such as a sheet metal cabinet door leaf, sheet metal drawer front, or sheet metal box lid, the handle having a longitudinal extension at whose ends is arranged at least one fastening means such as a screw, nut, hook fastening or clip-in fastening.

2. Description of Related Art

Handles of the type mentioned above are already known in a variety of embodiment forms. The handle is often combined with lock devices which are either mounted separate from the handle in the thin wall, such as is frequently encountered in tool cabinets, or the lock is integrated in the handle, which saves space. Further, in the latter case, mounting is simplified because usually fewer openings are needed in the sheet metal of the thin wall and often also fewer parts need to be mounted.

It is a drawback in the prior art that although lock inserts are used the variety of forms of the lock insert for a determined handle is limited. Therefore, when the number of different possible lock inserts increases, the quantity of handles which are needed for them and adapted to them also immediately increases.

SUMMARY OF THE INVENTION

It is the object of the invention to solve this problem and to provide a handle with a lock insert for mounting in a thin wall in which very different lock inserts can be mounted with one handle, wherein the arrangement is to be carried out in such a way that the lock does not require any additional openings and/or fastening devices independent of the handle and the handle also remains unchanged in spite of different lock shapes.

The object is met in that the lock insert comprises a housing with a collar in the vicinity of its front end, and in that a receiving space for the front end of the housing with the collar is provided at or in the vicinity of the one fastening means, this receiving space traversing the handle to the front side of the handle while changing in cross section. In this way, the lock insert can be secured in the door leaf by the handle so that the handle serves at the same time as fastening means for the lock insert in addition to its other function as a handhold or as a cover or as other means for imparting a design to a sheet metal cabinet, a drawer, or the like.

According to a further development of the invention, the collar has a contour which is not round, such as a prism-shaped, in particular a square, contour which makes it possible to mount the lock so as to be rotated by 90°, which is advantageous, for example, in rotary fasteners which must be oriented differently under certain conditions depending on the arrangement by which it engages in back in the switch cabinet According to another further development, the collar has rectangular or H-shaped edges and the opening is shaped in such a way that the collar can penetrate through the opening in one position, but not in the displaced or concealed position.

According to another further development of the invention, the front end of the housing on the near side of the collar has a round contour coaxial to the square or prism-shaped collar. This makes possible the arrangement of conventional cylinder locks.

According to another further development of the invention, the rear end of the housing on the far side of the collar has a square contour with rounded corners or a round contour with flattened portions, which prevents a relative rotation.

The receiving space can be arranged between two fastening means disposed at a distance from one another, which makes possible a particularly stable fastening.

The lock can be a rotary fastener or can comprise a ball-type snap-in closure or a locking cylinder. For technical reasons relating to mounting, it is advantageous to provide a door or the like with openings that are arranged symmetrically with respect to its center in order to use a handle on right-hand hinged doors or left-hand hinged doors. In such cases, it is advantageous when the handle forms, at its other end remote of the lock, a cover for an opening for a lock, which opening is provided in the thin wall, e.g., for the sake of symmetry.

The handle need not necessarily be designed as a handle, but can be reduced to a flange or rose or even, e.g., to a bar guide, specifically when a handle function is not required but a lock is to be provided nevertheless.

According to a further development of the invention, the hole pattern provided in the thin wall for the handle or rose is symmetric around an axis which is parallel to the longitudinal extension and around an axis perpendicular to the longitudinal extension.

A projection emerging from the handle or rose so as to be integral with it can serve as fastening means.

The projection can have an external thread for receiving a fastening nut or the like.

In case of a handle or a rose, the projection can form a channel which extends parallel to the thin wall and in which a slide can be inserted against spring force, this slide having at its end remote of the spring an inclined stop face and an inclined holding surface extending substantially at a right angle to the latter. A corresponding hole pattern provides the possibility for a particularly secure clip-in fastening in a thin wall.

BRIEF DESCRIPTION OF THE DRAWINGS

FIG. 1 shows a perspective view of a handle constructed according to the invention in which a locking cylinder drives a rotary fastener;

FIG. 2 shows a top view of the arrangement shown in FIG. 1;

FIG. 3 shows a plan view of the handle from FIG. 1;

FIG. 4 is a bottom view and FIG. 5 is a sectional view along line V-V in FIG. 4, the handle according to FIGS. 1 to 5 having a snap-in fastening device;

FIGS. 7A, 7B and 7C are views similar to FIGS. 6A to 6C showing a handle similar to that of FIG. 1, but in different stages of installation;

FIG. 8 shows the four parts making up the rotary fastener which can be received by the handle according to FIGS. 7A to 7C;

FIGS. 13A to 13D show a snap lock of a different constructional type in which a square opening rotated by 45 degrees is provided in the thin wall;

FIGS. 14 to 16 show differently shaped openings in the thin wall for collar shapes of corresponding contours;

FIG. 17A shows a perspective view of a reversible bar lock with an attachable reversible adapter cage which provides the bar lock with a mounting collar;

FIG. 17B is a perspective view showing the bar lock of FIG. 15A with mounted cage, the associated opening in a thin wall for mounting the adapter by insertion and displacement in the opening, and the escutcheon for clip-in mounting in the ends of the opening and locking of the adapter position by the cage contour being received in the locked position;

FIG. 17C shows an enlarged longitudinal section through the lock case with mounted cage, which combination is reversibly inserted in a thin wall;

FIG. 18A is a perspective view showing an arrangement similar to that in FIGS. 17A to 17C, but in the completely assembled state;

FIG. 18B shows an enlarged axial section through the escutcheon mounted in the wall;

FIG. 18C is a plan view of the parts located on the back side of the wall; and FIG. 18D is another enlarged sectional view through a non-reversible adapter holder for the lock case from FIG. 17C.

DETAILED DESCRIPTION OF EMBODIMENTS

Figure 6A:
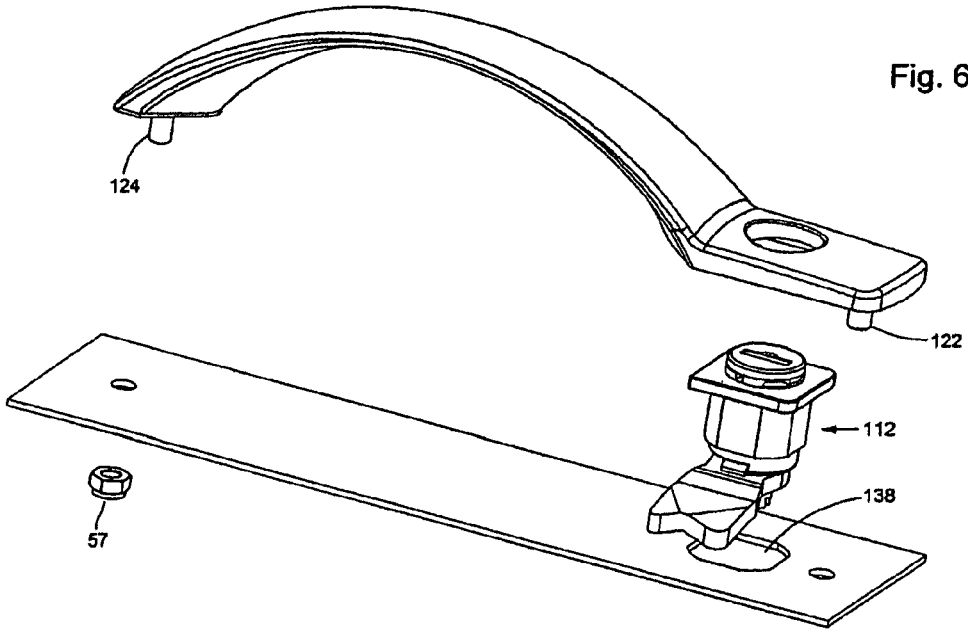
FIGS. 6A, 6B and 6C show a handle designed similar to that of FIG. 1, but with a stud fastening, wherein the three different views illustrate the progressive assembly of a closure of the constructional type according to the invention.
Figure 6B:
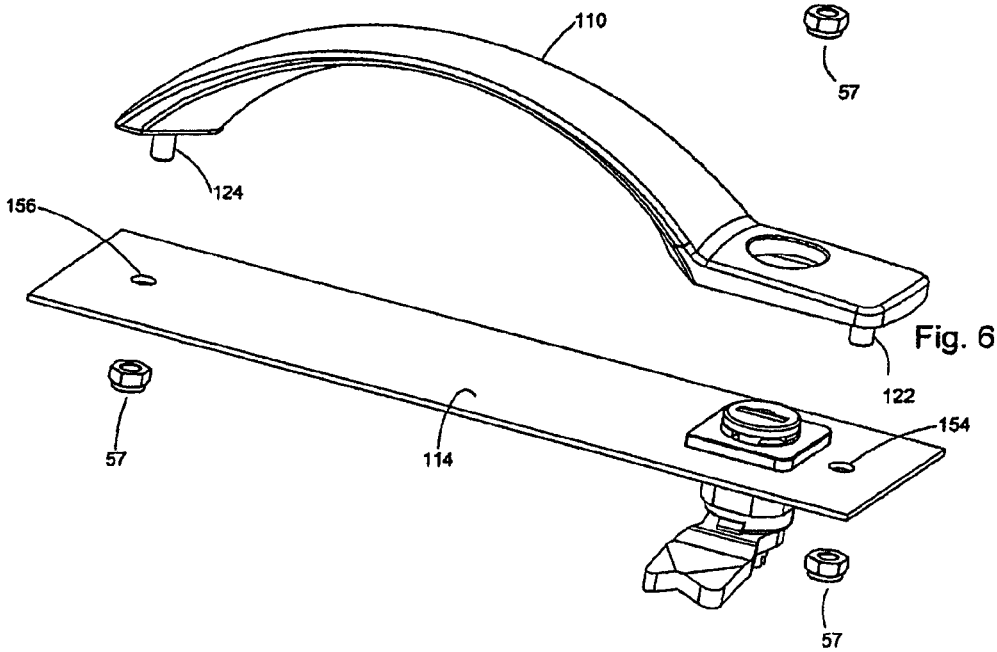
Figure 6C:
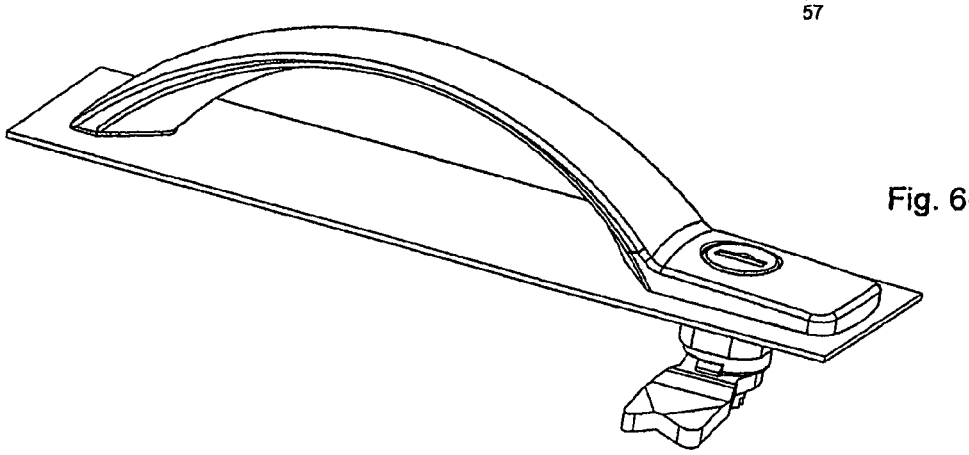

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIG. 1 shows a handle 10 with a lock insert 12 for mounting in a preferably thin wall 14 such as a sheet metal cabinet door leaf 14 which may be articulated in a door frame 16 (see FIG. 2) or such as a sheet metal drawer front which can be inserted into a cabinet, or such as a sheet metal box lid which closes a sheet metal box, wherein the handle 10 has a longitudinal extension at whose ends 18, 20 is arranged at least one fastening means such as a screw, nut, hook fastening or clip-in fastening 22, 24 (see also FIG. 5).

FIG. 5 and particularly FIG. 8 show how a lock insert can be constructed. Accordingly, the lock insert comprises a housing 26 which comprises a collar 28 in the vicinity of its front end 32. In the end of the handle in the vicinity of the fastening means, proceeding from the contact surface contacting the thin wall, a receiving space is provided for the front end of the housing with the collar, which receiving space traverses the handle to the front side of the handle while changing (decreasing in size, circular shape).

The receiving space 30 advisably has a contour similar to the collar, for example, a square contour. This prevents relative rotation.

The front end 36 of the housing 26 on the near side of the collar 28 has a round contour which is advisably coaxial to the square collar 28. In this way, the housing can be arranged in four different rotational directions. This is advisable in rotary fastener locks such as those provided herein.

The rounding can have chord-like necked down portion 34 which are provided at four edges so as to again prevent relative rotation within the correspondingly shaped opening in the thin wall (reference number 36).

According to FIG. 8, a commercially available locking cylinder 40, whose locking core 42 can be provided with a square 44, can be received in the housing 26. A correspondingly shaped rotary fastener 46 can be placed on this square 44 so as to be offset by 90° in four different positions and can be secured by screws 48. Projections 50 project from the collar 28 with stops for a projection 52 at the rim of the locking cylinder 40 so that the latter cannot rotate in the installed state.

Figure 7D:
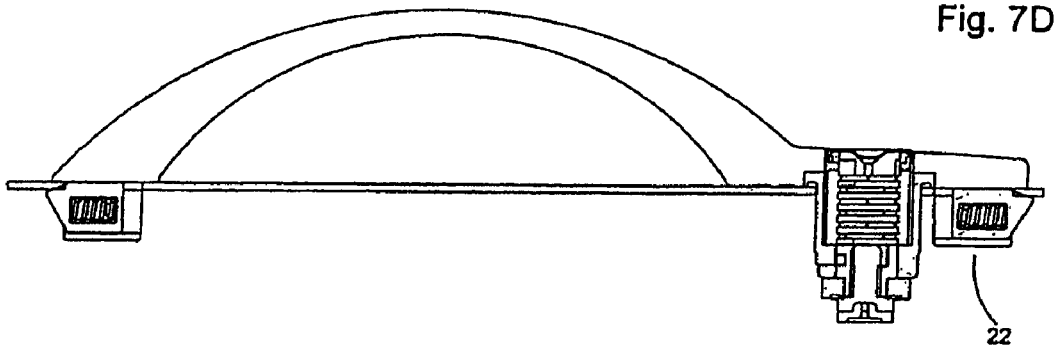
FIG. 7D is a view of the lock similar to FIG. 6D.
Figure 6D:
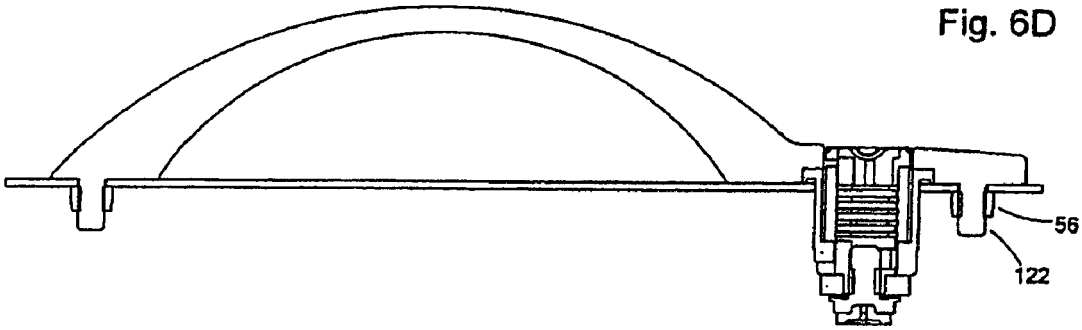
FIG. 6D shows an axial section through the handle according to FIG. 6C.
Figure 11D:
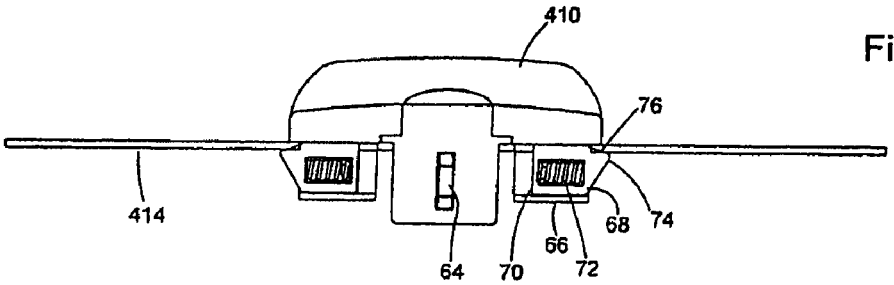
FIG. 11D is a side view showing an installed snap lock handle to illustrate its operation.

The locking core 42 can rotate only when a corresponding key is inserted and the core suitably releases the corresponding tumblers. Assembly of the four parts according to FIG. 8 results in a lock insert 12 according to FIG. 7A, shown in cross section in FIG. 5. As can be seen from FIG. 5A, the receiving space 30 is arranged between two fastening means 22, 24 having a distance from one another. The bore hole 38 is arranged between the bore holes 54, 56 in a corresponding manner. Assembly is carried out in such a way that the rotary fastener is first inserted through the opening 38 and the housing 26 is then pushed through with the collar coming to rest on the surface of the door leaf on the thin wall 14 as can be seen in FIG. 7B. Thereupon the handle 10 is inserted through openings 54, 56 and snapped in by the two fastening devices which are arranged at both of its ends in the form of clip-in arrangements 22, 24 in the present case. The housing with the collar penetrates into the corresponding openings and recesses of the handle and are securely held there by the handle. This state is shown in FIG. 7C.

In the embodiment forms according to FIGS. 6A to 6D, a stud 122 or 124 is provided as fastening means instead of the clip-in fastening. A threaded nut 56 can be screwed onto this stud 122 and 124, respectively, to hold the handle element on the thin wall 114. In a corresponding manner, the openings 154, 156 provided for the fastening elements 122, 124 are also shaped differently; namely, instead of being right-angled as in the embodiment form according to FIGS. 7A to D, a round hole is provided.

The disadvantage of this screw fastening is that the back of the thin wall must be accessible, whereas in the embodiment form according to FIGS. 7A to 7D insertion is carried out in a simple manner from the front without requiring that the back side be accessible.

The embodiment form according to FIGS. 9A to 9D differs from the embodiment form according to FIGS. 7A to 7D only in that the handle, at its other end 220 remote of the lock, forms a cover 58 for an additional opening 60 for a lock, which additional opening 60 may possibly be provided in the thin wall 214 for the sake of symmetry. In the embodiment form according to FIGS. 10A to 10C, the handle 110 is reduced to a flange or rose, simultaneously a visual covering for the locking cylinder device, so that the fastening function for the rotary fastener is the focus in this case.

Naturally, the handle can be carried out, and the door also opened, by a corresponding tool. In any case, the key itself could be used for opening by pulling on it as soon as the rotary fastener has reached the release position.

Figure 10A:
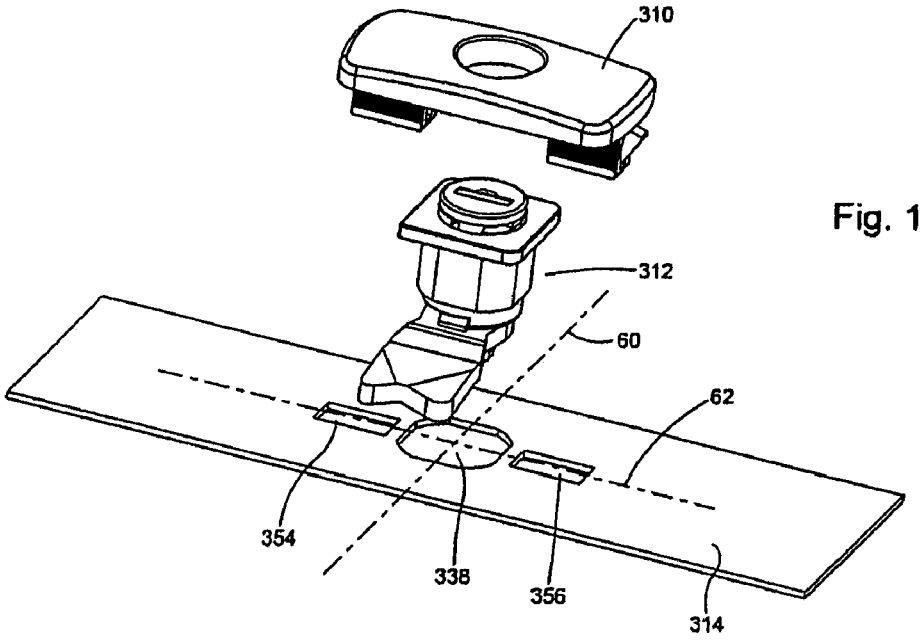
FIGS. 10A to 10C show the different installation situations for a handle which is reduced to a rose and which receives a rotary fastener.

As can be seen in FIG. 10A, a hole pattern is provided for the thin wall 14 in which an axis arranged parallel to the longitudinal extension 62 and an axis 60 perpendicular to the latter are arranged symmetrically.

Figure 9D:
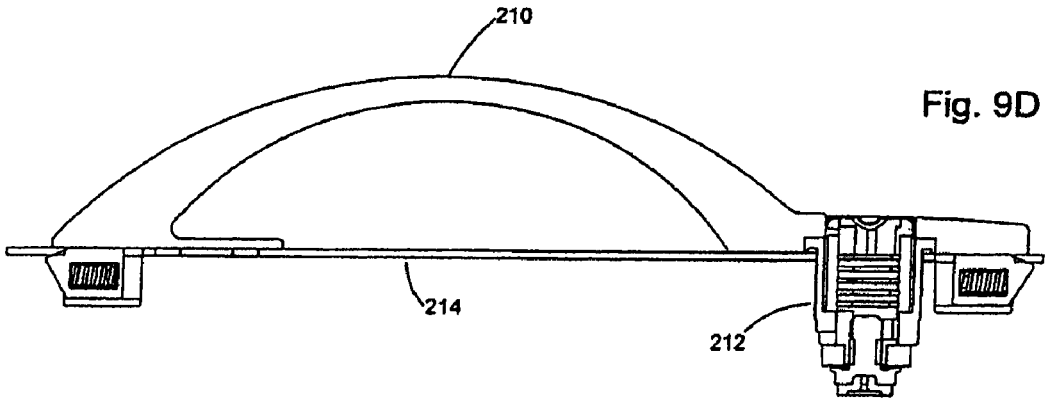
FIGS. 9A to 9C and FIG. 9D show a closure in different assembly stages and in cross section having, in contrast to the embodiment form described thus far, a cover plate which makes possible and which covers a symmetrical arrangement of holes in the door leaf which, among other things, makes it possible for the handle arrangement to rotate when the hinging direction of the door is changed.
Figure 9A:
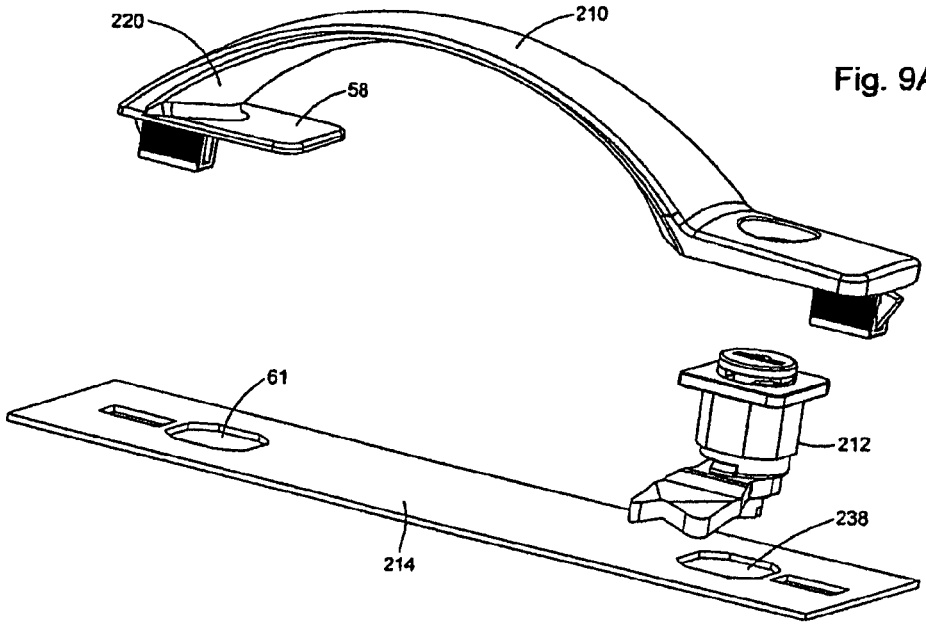
Figure 9B:
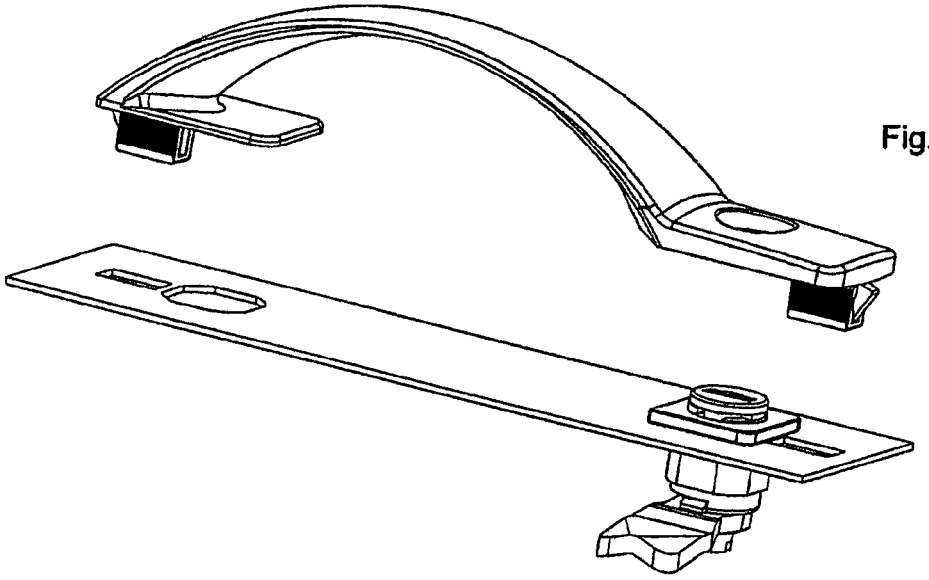
Figure 9C:
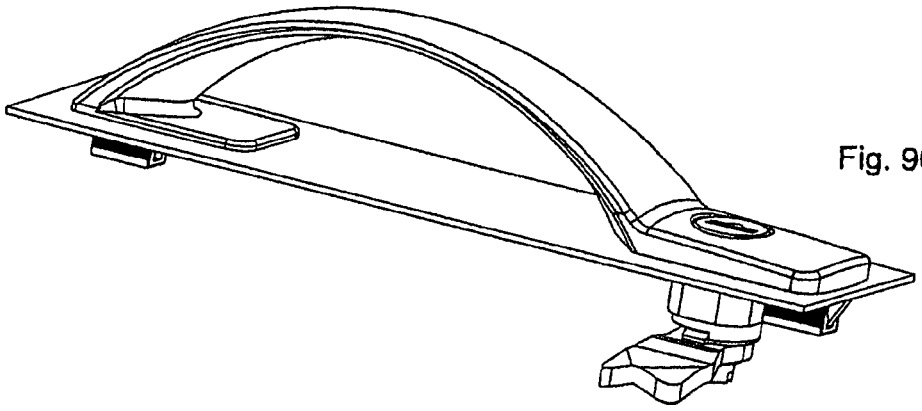
Figure 10B:
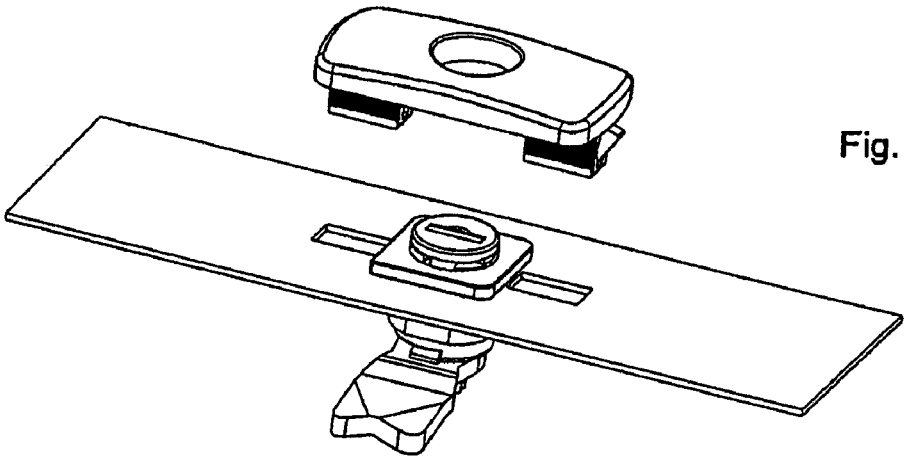
Figure 10C:
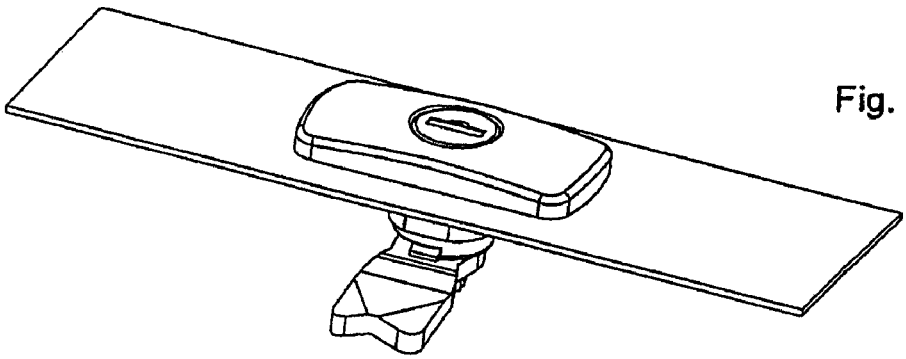

Accordingly, the hole pattern in the arrangement according to FIG. 9A is also arranged symmetrically in a twofold manner.

Figure 11A:
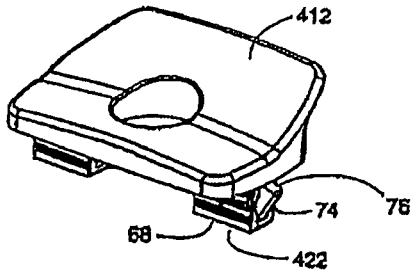
FIGS. 11A, 11B and 11C show different installation situations and a sectional view of a handle having a snap lock as closure.
Figure 11B:
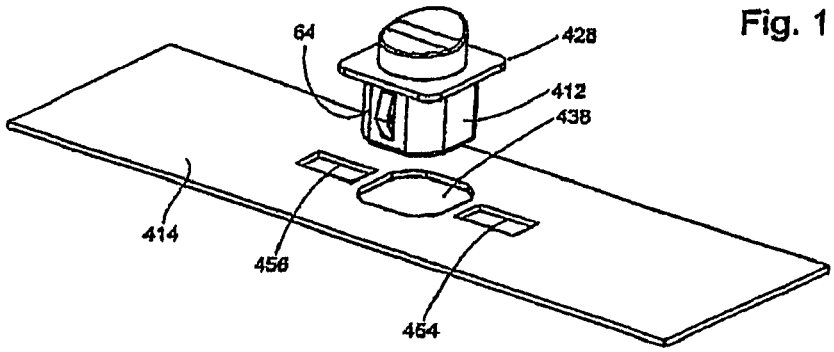
Figure 11B:
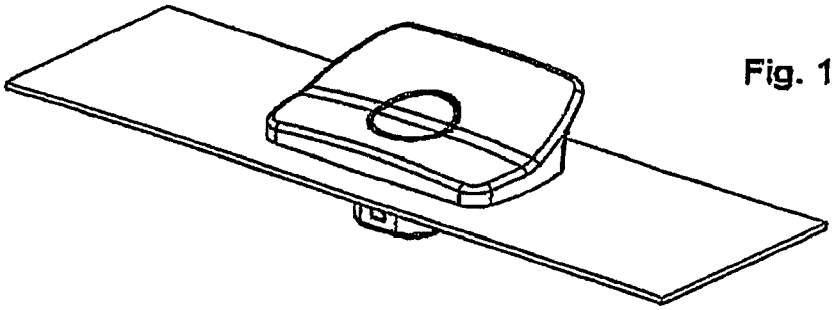
Figure 11C:
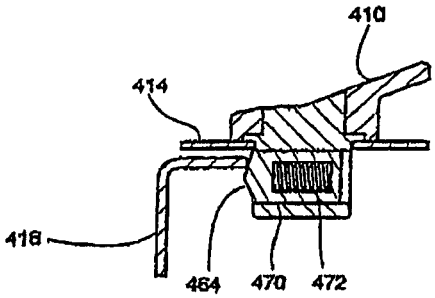

In the embodiment form according to FIGS. 11A to 11D, a closure is provided as a slide snap lock (see reference number 464). FIG. 11C shows how the snap lock 464 engages behind the frame 416 of a switch cabinet in order to securely hold the door 414.

It should be noted that the projection 422 of the fastening means according to FIG. 11A forms a channel 68 which extends parallel to the thin wall 414 similar to snap lock 64 in which a slide 70 can be inserted against spring force 72, this slide 70 having an inclined stop face 74 at its end remote of the spring 72 and an inclined holding surface 76 extending substantially at right angles to the latter.

Figure 11E:
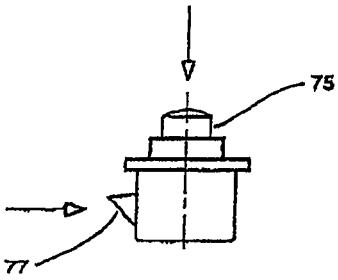
FIG. 11E is a side view showing a latch bolt lock with push button unlocking which can be installed according to the invention.
Figure 12A:
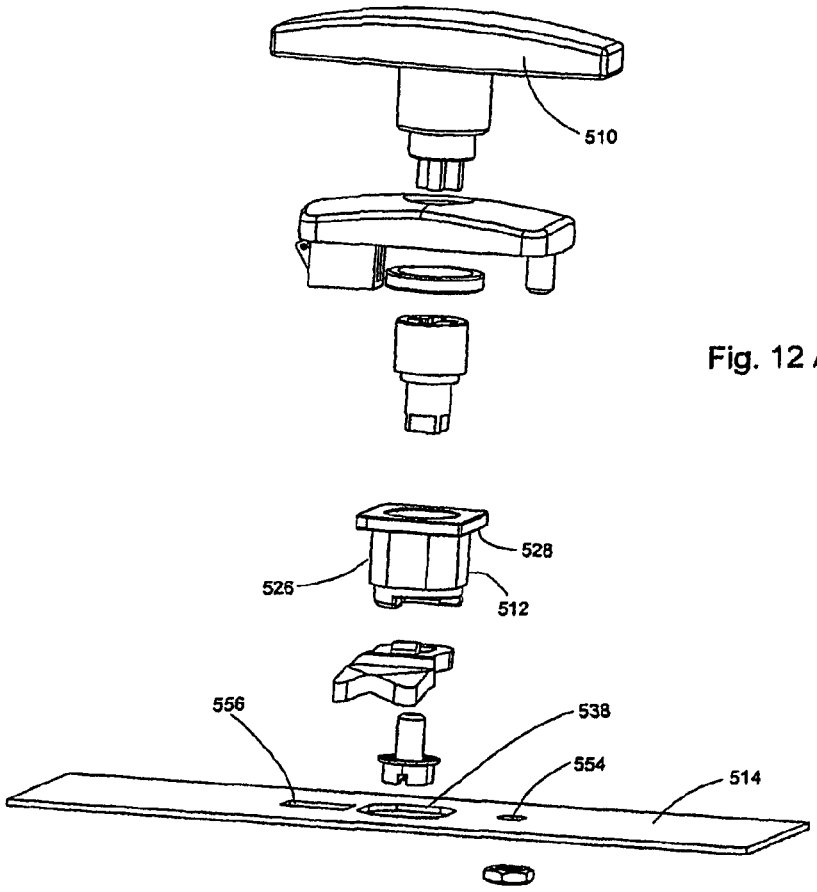
FIGS. 12A to 12C and FIG. 12D in views similar to those in FIGS. 6A to 6D show the various stages of construction of a T-handle closure with rotary fastener, which closure can be fastened in the thin wall alternatively by means of a clip-in fastening (left side) or screw fastening (right side)
Figure 12B:
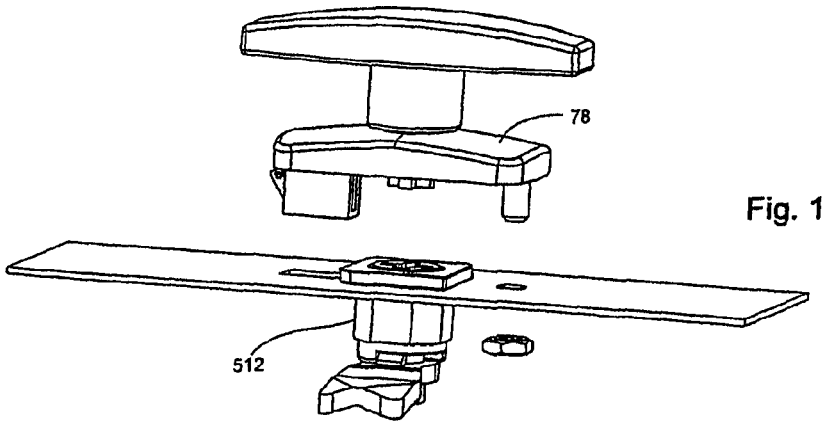
Figure 12C:
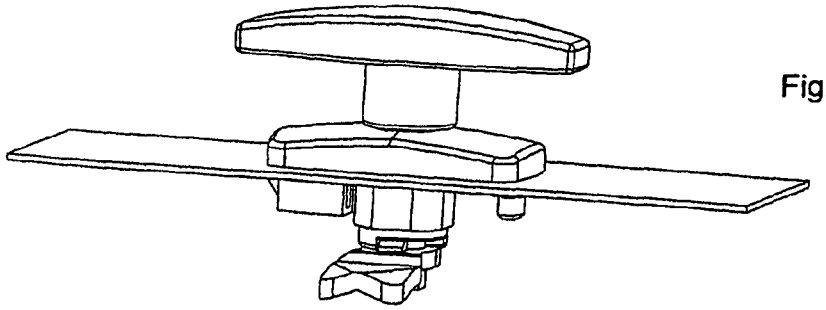
Figure 12D:
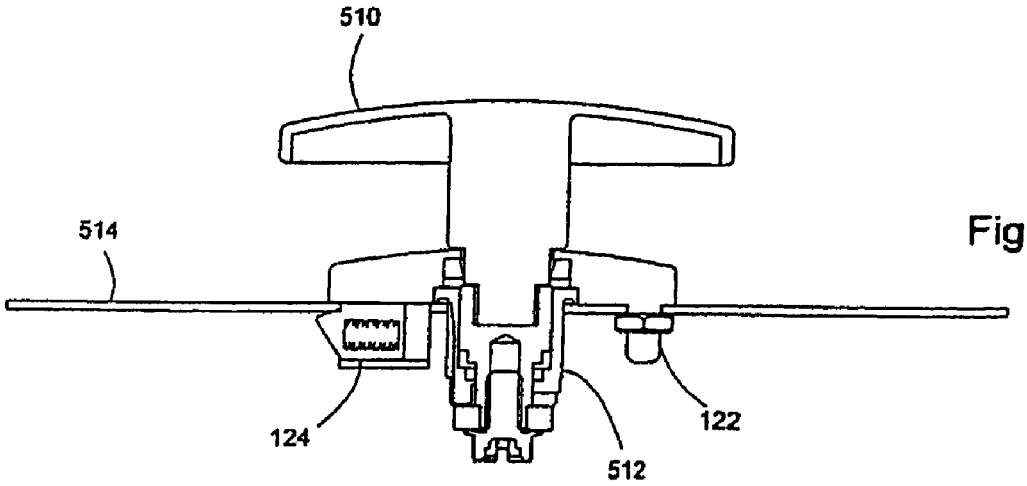

The side view in FIG. 11E shows a latch bolt lock with push button unlocking which can be installed according to the invention. Pressing the button 75 leads to a retraction of the latch bolt 77 as indicated by the arrow.

FIGS. 12A to 12C and FIG. 12D, in views similar to those in FIGS. 6A to 6D, show the different construction stages of a T-handle closure 510 with rotary fastener, which closure can be fastened alternatively by means of a clip-in fastening (left side) in rectangular openings 556 or by means of a screw fastening (right side) in round holes 554 in the thin wall 514.

In the embodiment forms described thus far, the lock housing is inserted, for example, into the opening 538 from the outside, i.e., the collar 528 of the housing 526 need not be inserted through the opening; it remains on the outer side and is securely held by subsequent arrangement of the handle 510 (see FIGS. 12B and 12C) by its olive 78.

However, in the embodiment form according to FIGS. 13A to 13D which shows a snap lock of a different constructional type, the collar 628 can be inserted through the opening 638 from the back. A square opening 638 which is rotated by 45 degrees is provided in the thin wall 614 so that the opening rims of the housing are securely held after insertion and rotation of the housing by 45 degrees when the rose is placed on the lock.

FIG. 14 shows an embodiment form with an opening 738 with a first wide region 80 through which the collar 728 of the housing 712 can be inserted, and a second narrow region 82 where the collar does not fit through and is securely held. The housing is mounted in that the collar 728 of the housing 612 is first inserted from behind in the wide region 80, whereupon a translational displacement of the housing in the narrow region 82 is carried out and subsequently the handle with the collar is held in the manner described above in a recess formed by the handle or the like so as to be fixed with respect to rotation relative to it and secured axially against displacement.

FIGS. 15 and 16 show an H-shaped collar shape 828 and a correspondingly contoured opening 838, wherein displacement (see FIG. 16) is also carried out in this case after insertion according to FIG. 15, in which position the handle is mounted so as to securely hold the collar.

FIG. 17A is a perspective view showing a reversible bar lock 912 with an attachable, reversible adapter cage 84 that creates a mounting collar 928 for the bar lock. The adapter cage 84 is symmetrically constructed (see also the enlarged longitudinal section through the lock case 912 with mounted cage 84 in FIG. 17C) in such a way that the combination can be inserted in a thin wall 914 in a reversible manner. To avoid increasing the overall height on the back side of the lock case, the arrangement of the cage is adapted to the lock case 912 in such a way that it is displaceable by the protruding amount 86. Accordingly, the portion of the cage that is not needed disappears into the countersunk areas of the front face of the lock case 912 that are present in any case (see the underside in FIG. 17C).

FIG. 17B is a perspective view showing the bar lock 912 of FIG. 15A with mounted cage 84, the associated opening 938 in a thin wall 914 for mounting the adapter 84 in that its part projecting over the lock case 912 is inserted and displaced in the opening 938, and the escutcheon 910 for snap-in mounting in the ends 956 of the opening 938 and locking the adapter position in that the cage contour is received in the locked position insofar as it projects through the opening 938 of the thin wall 914 and protrudes over its front side plane.

FIG. 18A is a perspective view showing an arrangement similar to that in FIGS. 17A to 17C, but in the completely mounted state; namely, a bar lock 1012 which engages around rim areas of an opening 1038 by means of an adapter 1028 with collar 1028, which adapter 1028 is asymmetric in the present case, after insertion through and displacement in the opening 1038, whereupon an escutcheon which can be secured in the opening 1038 by means of clip-in devices 1022, 1024 in turn securely holds the adapter 1028 in the receiving space 1030 (see FIG. 18B showing an enlarged axial section through the escutcheon 1010 mounted in the wall 1014).

FIG. 18C is a plan view of the parts located on the back side of the wall 1014, and FIG. 18D is an enlarged sectional view through a non-reversible adapter holder 1028 for the lock case 1012 of FIG. 17C.

The lock case 1012 is known per se and comprises two halves, between which a pinion 92, which drives locking bars 90, is arranged so as to be displaceable and rotatable. The pinion 92 is driven in turn by a drive 94 that can be actuated by a socket wrench.

The two lock case halves can be glued together or held together through special screwing or riveting. In this case, they are held together by a head screw 96 which is received by a threaded bore hole in the adapter 1028 (right-hand side of FIG. 18D) or, alternatively, by flattening or head-forming 98 of a pin emerging from the adapter 1028 (left-hand side of FIG. 18D).

COMMERCIAL APPLICABILITY

The invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10, 110, 210, 310, 410, 510, 610, 910, 1010 handle
12, 112, 212, 312, 412, 512, 612, 712, 812, 912, 1012 lock insert
14, 114, 214, 314, 414, 514, 614, 714, 814, 914, 1014 thin wall
16 door frame
18 end
20, 220 end
22, 122, 422, 1022 fastening means, screw, nut, clip-in device
24, 124, 1024 fastening means, screw, nut, clip-in device
26 housing
28, 928, 1028 collar, adapter
30, 1030 receiving space
32 front end
33 rear end
34 flattened portion
36 chord-like constrictions
38, 138, 238, 638, 738, 838, 938, 1038 opening
40 locking cylinder
42 locking core
44 square
46 rotary fastener
48 screw
52 projection
54, 154, 354, 454 opening, left-hand side
55 projection
56, 156, 356, 456, 956 opening, right-hand side
57 nut
58 cover
60 axis of symmetry
61 additional opening
62 axis of symmetry
64, 464 snap lock
66 projection
68 channel
70, 470 slide
72, 472 spring force
74 inclined stop face
75 button
76 inclined holding face
77 latch bolt
78 olive
80 wide region
82 narrow region
84 adapter cage
86 amount
88 front side plane
90 locking bars
92 pinion
94 drive
96 screw
98 rivet

We claim:

1. A handle with a lock insert;

wherein the handle is suitable for mounting in a thin wall;

wherein the handle has a longitudinal extension at whose ends is arranged at least one fastening means;

wherein the lock insert comprises a housing with a collar in the vicinity of a front end of the housing; and wherein a receiving space for the front end of the housing with the collar is provided at an end of the handle in the vicinity of the fastening means proceeding from the contact surface contacting the thin wall, the receiving space passing through the handle to the front side of the handle while changing in cross section;

wherein the at least one fastening means is a rectangular projection which proceeds from the contact surface contacting the thin wall, and has a cross section that is not round;

wherein, after the at lease one fastening means is mounted in the thin wall, the at lease one fastening means projects through an opening in the thin wall which is correspondingly not round;

wherein the rectangular projection, which serves as the at least one fastening means, emerges from the handle so as to be integral with the handle;

wherein the rectangular projection is configured to have a channel which extends parallel to the thin wall and in which a slide is inserted against a spring; and wherein the slide has, at its end remote of the spring, an inclined stop face and an inclined holding surface, the stop face extending substantially at a right angle to the holding surface, and the holding surface being locked through self-locking frictional forces of the slide in the channel.

2. The handle according to claim 1;

wherein the collar has a contour which is not round.

3. The handle according to claim 2;

wherein the collar has rectangular or H-shaped edges such that, when the opening in the thin wall has a corresponding contour, the opening can be penetrated in one position of the collar but not in the displaced or rotated position.

4. The handle according to claim 1;

wherein the front end of the housing on the near side of the collar has a round contour coaxial to the square or prism-shaped collar.

5. The handle according to claim 1;

wherein the rear end of the housing on the far side of the collar has a square contour with rounded corners or a round contour with flattened portions.

6. The handle according to claim 1;

wherein the receiving space is arranged between two fastening means disposed at a distance from one another.

7. The handle according to claim 1;

wherein the lock is a rotary fastener lock.

8. The handle according to claim 1;

wherein the lock is a snap lock, a latch lock, or a lock case.

9. The handle according to claim 1;

wherein the lock comprises a locking cylinder.

10. The handle according to claim 1;

wherein the handle forms, at its other end remote of the lock, a cover for an opening for a lock, which opening is provided in the thin wall for the sake of symmetry or for other reasons.

11. The handle according to claim 1;

wherein the handle is reduced to a flange, rose, or bar guide.

12. The handle according to claim 1;

wherein the contour pattern provided for the handle for insertion through the thin wall is symmetric around an axis which is parallel to the longitudinal extension and around an axis perpendicular to the longitudinal extension.

13. The handle according to c1aim 1;

wherein an other fastening means is arranged at an opposite end of the longitudinal extension of the handle from the end at which the at least one fastening means is arranged; and wherein the other fastening means is an other projection which has an external thread configured to receive a fastening nut.

* * * * *